US010166789B2

(12) United States Patent
Campanini

(10) Patent No.: US 10,166,789 B2
(45) Date of Patent: Jan. 1, 2019

(54) PRINTING DEVICE

(71) Applicant: CUSTOM S.P.A., Fontevivo (Parma) (IT)

(72) Inventor: Alberto Campanini, Fidenza (IT)

(73) Assignee: CUSTOM S.P.A., Fontevivo (Parma) (IT)

( * ) Notice: Subject to any disclaimer, the term of this patent is extended or adjusted under 35 U.S.C. 154(b) by 0 days.

(21) Appl. No.: 15/538,748

(22) PCT Filed: Dec. 28, 2015

(86) PCT No.: PCT/IB2015/060004

§ 371 (c)(1),
(2) Date: Jun. 22, 2017

(87) PCT Pub. No.: WO2016/108170

PCT Pub. Date: Jul. 7, 2016

(65) Prior Publication Data

US 2017/0291432 A1 Oct. 12, 2017

(30) Foreign Application Priority Data

Dec. 29, 2014 (IT) ..... MO2014A0368

(51) Int. Cl.

| | |
|---|---|
| ***B41J 11/00*** | (2006.01) |
| ***B41J 2/32*** | (2006.01) |
| *B41J 11/66* | (2006.01) |

(52) U.S. Cl.

CPC ..... *B41J 11/0095* (2013.01); *B41J 2/32* (2013.01); *B41J 11/006* (2013.01); *B41J 11/663* (2013.01); *B41J 2202/31* (2013.01)

(58) Field of Classification Search

CPC . B41J 2/32; B41J 11/006; B41J 11/663; B41J 2002/31

See application file for complete search history.

(56) References Cited

FOREIGN PATENT DOCUMENTS

| | | | |
|---|---|---|---|
| CN | 106183483 | A | 12/2016 |
| EP | 1676708 | A1 | 7/2006 |
| EP | 2546062 | A1 | 1/2013 |
| EP | 2746055 | A1 | 6/2014 |
| FR | 2796055 | A1 | 1/2001 |
| JP | S5732990 | A | 2/1982 |
| WO | 2014114351 | A1 | 7/2014 |
| WO | 2014115000 | A1 | 7/2014 |

OTHER PUBLICATIONS

International Search Report & Written Opinion of the International Searching Authority Application No. PCT/IB2015/060004 Completed: Mar. 14, 2016; dated Mar. 23, 2016 12 pages.

*Primary Examiner* — Lamson Nguyen
(74) *Attorney, Agent, or Firm* — Whitmyer IP Group LLC

(57) ABSTRACT

A printing device for printing tickets in public places, with an anti-paper jam system in which an optical sensor for detecting the presence of paper is arranged at a zone where a rise of the paper occurs in case of occlusion of the paper outlet mouth; before the start of a print, the paper is retracted with respect to the sensor, whereby the sensor is OFF; when the print starts, the paper advances until arriving in front of the sensor, whereby the sensor turns ON; from this moment on, if the sensor returns OFF, it means that the paper is no longer detected by the sensor, because it has been raised by an occlusion, whereby the advancing of the paper is interrupted.

11 Claims, 3 Drawing Sheets

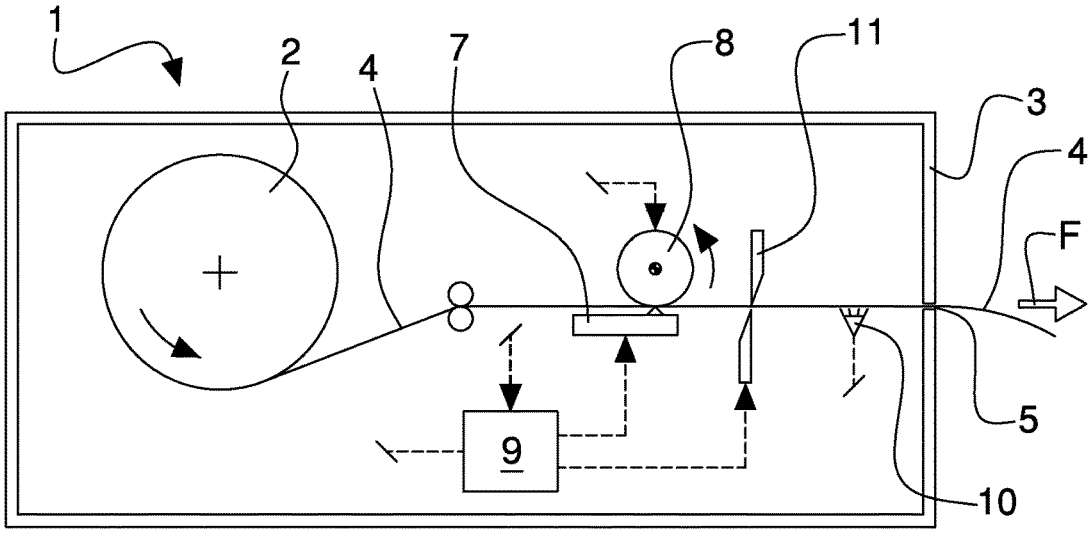
Fig. 1
Fig. 3
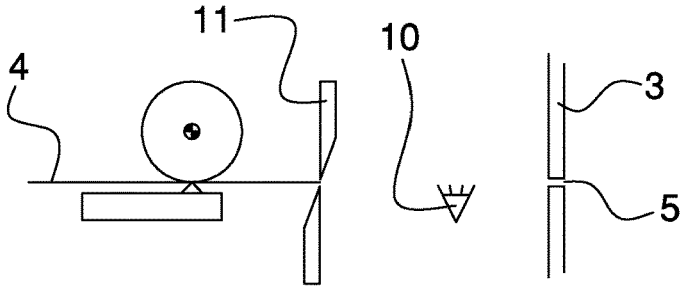
Fig. 4
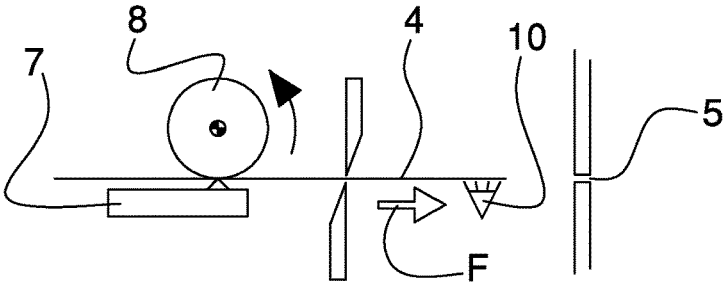
Fig. 5
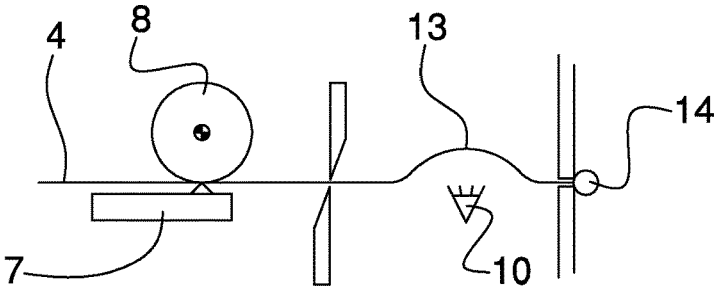

PRINTING DEVICE

TECHNICAL FIELD

The invention relates to a printing device and a method for controlling thereof, which can be used in particular for printing thermal paper unrolled from a reel.

BACKGROUND

In a specific, but not exclusive, manner, the invention may find application for the print in real time of ticket, sales receipts, receipts, etc., e.g., printers which can be used in public places (kiosks, parking lots, etc.).

In particular, the present invention relates to a printing device produced in accordance with the preamble of the first claim. Such a device is already known, e.g., from the patent publication EP 1676708.

The device shown by EP 1676708 is provided with a system, which prevents jamming by interrupting the print before the formation of a paper entanglement, due for example to occlusion or transversal arrangements of the paper itself. However, this anti-jamming system provides for the use of a spring-driven microswitch actuatable by the raised paper, or a door which can be lifted by the same paper, with a consequent increase in structural complexity and manufacturing costs.

The prior art further comprises the patent publication FR 2796055, which shows a printer for tickets in which a strip of paper, unrolled from a reel, advances through a curved guide, which folds the strip, with a safety device which interrupts the advancing when the strip, due to the action of an entanglement of the paper (or an early withdrawal of the paper by the user before the print has ended), gets near to a paper detection optical sensor. However, this safety device intervenes when the paper entanglement has already jammed the printer, whereby the printer will be able to restart only after a manual intervention to remove the entanglement.

SUMMARY

It is an object of the invention to provide a printing device capable of obviating the above-mentioned limitations and drawbacks of the prior art.

An advantage is to interrupt the print of a document in case of abnormal or irregular advancing of the paper, for example in case of an occlusion at the paper outlet mouth or an abnormal arrangement of the paper itself, or of any other obstruction to the normal advancing of the paper.

An advantage is to provide an anti-jamming system capable of preventing the formation of a paper entanglement inside the printer if the normal advancing of the paper is obstructed.

An advantage is to automatically resume the print of the document immediately after the removal of the obstruction without stopping the printing device.

An advantage is to implement an anti-jamming system by using the sensor which is typically present in a printing device and which serves for detecting the presence of paper at the outlet (e.g., a printed ticked not withdrawn by the user) and for preventing the start of a new print if the outlet is occupied by the paper.

An advantage is to use the same sensor (e.g., an optical sensor) for detecting both an abnormal presence of paper at the outlet before a print has started, and an obstruction to the normal advancing of the paper during the print.

An advantage is to implement a printing device (in particular a device located in public places for printing tickets and/or receipts and/or sales receipts and/or labels or the like) which is constructively simple and cost-effective.

An advantage is to have an anti-jamming system with a high reliability, in particular, a system free of movable members.

It is an object of the invention to provide a method for controlling a printing device able to obviate the above-mentioned limitations and drawbacks of the prior art.

Such and other objects and advantages are achieved by the device and the method according to one or more of the claims set out below.

In one example, a printing device comprises an anti-paper jam system with a paper presence sensor arranged at a zone where a rise of the paper occurs if the normal advancing of the paper itself is obstructed; before the print of a document has started, the sensor does not detect the presence of paper because it is arranged before the sensor; when the print of a document is activated, the paper begins to advance until arriving for the first time in front of the sensor, which will detect its presence; from that moment on, until the end of the print of the document, if the sensor returns to no longer detecting the presence of paper, then the advancing of the paper will be interrupted.

BRIEF DESCRIPTION OF THE DRAWINGS

The invention will be best understood and implemented with reference to the annexed drawings, which illustrate an exemplary, non-limiting embodiment thereof.

FIG. 1 is a scheme of an exemplary embodiment of a printing device realized in accordance with the invention.

FIGS. 3 to 5 schematically show three different operative steps of the printing device of FIG. 1.

DETAILED DESCRIPTION

Figure 2:
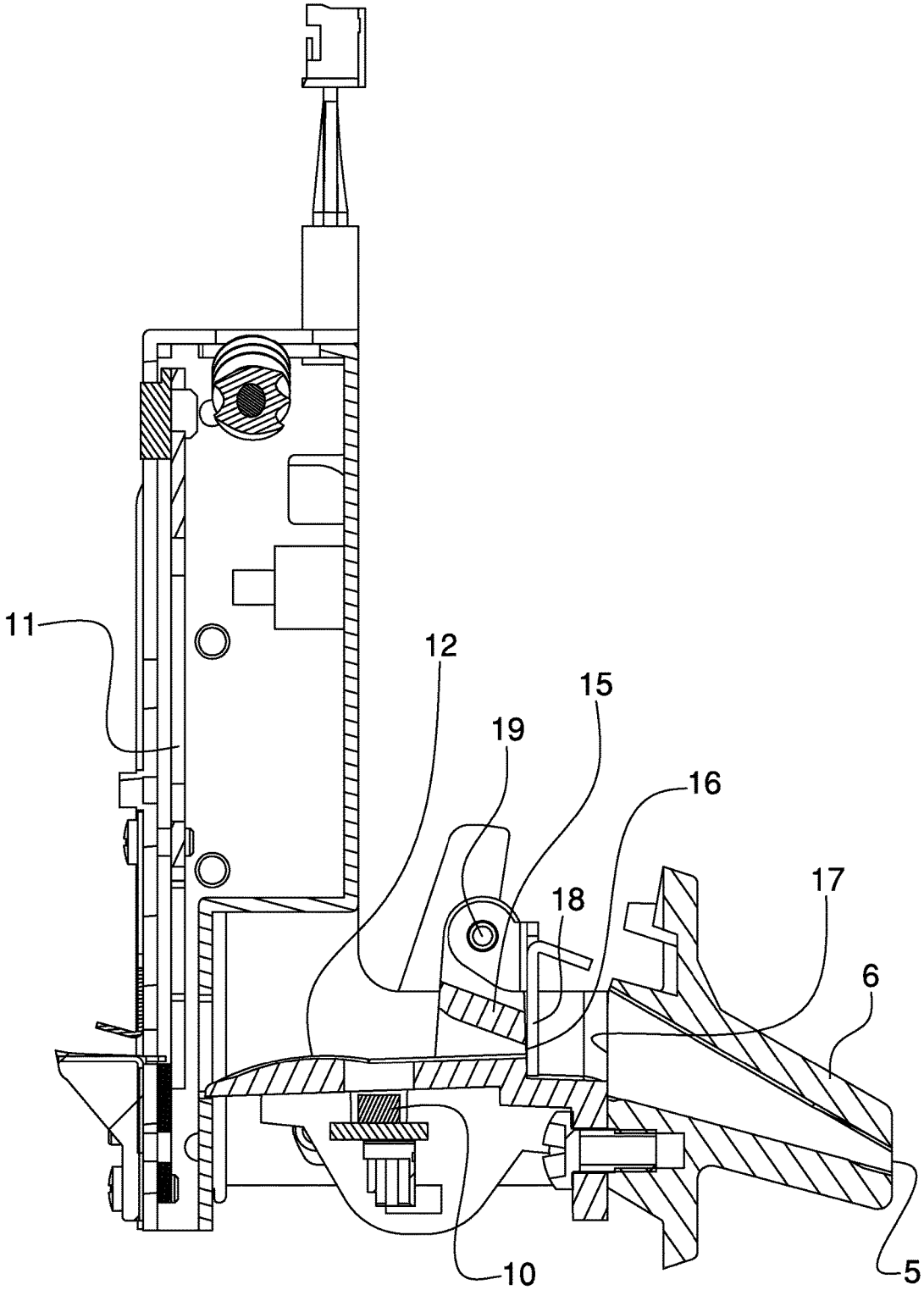
FIG. 2 is a vertical section of a detail of the paper outlet zone of the printing device of FIG. 1.

With reference to the above-mentioned figures, with 1 a printing device is generally indicated, which can be used in particular for printing tickets, sales receipts, receipts, labels, or another type of documents printed in real time. The printing device 1 may be used, in particular, in kiosks, parking lots, gaming rooms, stations, airports or other public places.

The printing device 1 may comprise, in particular, a magazine for housing printing paper or another type of printing support. The printing support which can be used by the printing device at issue may be, in particular, paper, e.g., thermal paper (in the specific case, unrolled from a reel).

In the scope of the present patent text (description and claims), with "paper" will be meant any type of printing support suitable for the print (in particular, with a thermal printing head), for example, a printable material in the form of a strip, in particular, rolled onto a reel, such as a reel of (thermal) paper, or a set of sheets in a fan-fold continuous format, or a set of distinct sheets (made of paper or other printable material), or a set of sheets arranged in a row on a support in the form of a strip, or also another type.

In the specific case, the magazine may comprise, in particular, at least one seat arranged for receiving at least one reel 2 of thermal paper. However, the magazine may comprise other examples of paper magazines (also of a known type).

The printing device 1 may comprise, for example, a containment body, or casing 3, (for example, box-shaped) suitable to contain the various components of the printing device itself, or at least part of them.

The printing device 1 may comprise, in particular, a path for supplying paper 4 coming from the magazine (unrolled from the reel 2) towards an outlet 5, where the user may withdraw the printed document. The outlet 5 may be arranged, for example, on a wall of the casing 3. The outlet 5 may comprise a (horizontal) slot. The outlet 5 may be arranged on a mouth 6 projecting from a wall of the casing 3. The path of the paper 4 may comprise, for example, one or more tensioning rolls and/or one or more conduits or channels for guiding and directing the paper 4.

The printing device 1 may comprise, in particular, printing means, for example, printing means comprising a printing head 7, in particular a thermal printing head, arranged along the paper path for printing on a side of the paper 4 (e.g., a thermally sensitive side). An advancing roll 8 opposite the printing head 7 may be operatively associated to the printing head 7. The paper advancing roll 8 is frontally coupled to the printing head 7. The roll 8 operates in contact with the paper side opposite the printable side. The path of the paper 4 will pass between the printing head 7 and the advancing roll 8.

The roll 8 will be controlled (by control means 9, which may comprise programmable electronic control means) in cooperation with the printing head 7, for advancing the paper 4 in a coordinate manner during the print.

The control means 9 of the device may comprise, in particular, an electronic board connected to the various sensors and actuators of the printing device.

The device 1 may comprise program instructions implementable on these control means 9 for running the steps of a method for controlling the printing device 1, which will be better described herein below.

The printing device 1 may comprise, in particular, at least one paper presence sensor 10, which is arranged along the above-mentioned path. The sensor 10 may be arranged, as in this specific example, downstream of the printing head 7.

The printing device 1 may comprise, in particular, cutting means 11 for separating the printed document from the rest of the paper. Such cutting means 11 may comprise, as in this example, at least one motorized blade (whereby the document will be able to be separated on command by the electronic control means 9). The cutting means may comprise, in other, non-illustrated examples, a stationary (non-motorized) blade, in which case the separation of the document may be of the tear-off type, where the user detaches the document by manually pulling it. The sensor 10 may be arranged, as in this specific example, downstream of the cutting means 11.

The printing device 1 may comprise, in particular, a ditch or rise 12 arranged along the paper path for promoting or triggering a rise 13 of the advancing paper 4 when there is an occlusion, or another obstruction to the advancing of the paper 4, downstream of the rise 12.

It is possible to arrange other means for promoting the rise of the paper (in addition or replacement of the rise 12), for example, a downward bending of a paper guide conduit arranged along the supplying path (e.g., after the sensor 10) for triggering the rise of the paper in the case of an occlusion at the outlet 5.

The sensor 10 for detecting the presence of paper may be arranged in the path at the rise of the paper (promoted by the rise 12), in particular for detecting a presence of non-raised paper, i.e., for detecting paper in case of a normal advancing during the print (normal situation of paper advancing without obstruction) or paper not withdrawn by the user at the end of the print (abnormal situation of document which occupies the outlet) and for not detecting paper in the case of a presence of raised paper (abnormal situation with a rise 13 during the print, see FIG. 5), and in the case of absence of the paper (normal situation at the beginning of the print, as in FIG. 3, or in the resting periods between a print and the other).

The sensor 10 may comprise, for example, an optical sensor having a focus centered where the non-raised paper is located.

The (programmable electronic) control means may comprise means for interrupting the printing means (roll 8 and/or head 7) if the sensor 10 passes from detecting the presence of non-raised paper, i.e., from a normal printing situation (FIG. 4), to no longer detecting the presence of non-raised paper, i.e., to an abnormal printing situation with an occlusion 14 at the outlet 5 (FIG. 5). The above-mentioned means for interrupting the printing means may comprise, in particular, program instructions implementable on a processor of the control means 9.

The control means may comprise means for starting a print (by actuating the printing means) only if the sensor 10 does not detect the presence of non-raised paper, i.e., in a normal situation between a print and the other (situation of non-occupied outlet, FIG. 3). The above-mentioned means for starting a print may comprise, for example, program instructions implementable on the processor of the control means.

The control means may comprise means for continuing the print, after the sensor 10 has detected the presence of non-raised paper for the first time from the beginning of the print (FIG. 4), if the sensor 10 continues to detect the presence of non-raised paper, i.e., in the normal situation of print (situation of absence of an obstruction to advancing). As stated, the control means may comprise means for interrupting the print if the sensor 10 no longer detects the presence of non-raised paper, i.e., in the abnormal situation of print (situation of presence of an obstruction to advancing, FIG. 5). The above-mentioned means for continuing the print and means for interrupting the print may comprise, for example, program instructions implementable on the processor of the control means. The control means may comprise means for resuming the same print, after the print has been interrupted as described above, if said sensor 10 returns to detect the presence of non-raised paper, in particular when the accidental obstruction (e.g., a finger of the user) is removed, whereby the paper in the raised configuration may return, by virtue of its own elasticity, in the non-raised configuration in which it is detected by the sensor 10. Such means for resuming the same print may comprise, for example, program instructions implementable on the processor of the control means.

The control means may comprise, in particular, means for running the cutting means at the end of a print, so as to separate the printed document from the rest of the paper. It may be provided that the printed document has to be then withdrawn by the user. The control means may comprise, in particular, means for allowing a new print, at the end of the cutting, only if the sensor 10 does not detect the presence of non-raised paper, i.e., in a normal situation between a print and the other of non-occupied outlet (the printed document has been withdrawn by the user, FIG. 3). Such means for allowing a new print may comprise, for example, program instructions implementable on the processor of the control means. In other terms, the control means may be programmed to activate the cutting means 11 at the end of the print of a ticket and to allow the print of a new ticket only after the cutting means 11 have been actuated and only if the sensor 10 does not detect the presence of non-raised paper, i.e., in a normal situation between a print and the other of non-occupied outlet.

The device 1 may comprise protecting means for protecting the sensor 10 by preventing or making at least difficult the introduction of objects from outside, through the outlet 5, towards the sensitivity zone of the sensor 10. Such protecting means may comprise an intermediate mouth 15 for the passage of paper arranged along the supplying path between the sensor 10 and the outlet mouth 6, at a distance from the outlet mouth 6.

The intermediate mouth 15 may have a passage section convergent towards the outlet 5. As in this specific case, the outlet mouth 6 may also have a passage section convergent towards the outlet 5. The intermediate mouth 15 may have an outlet 16 arranged at a distance from an inlet 17 of the outlet mouth 6. The outlet 16 of the intermediate mouth 15 may be, as in this example, smaller than the inlet 17 of the outlet mouth 6. The outlet 5 may be arranged, as in this example, at a lower height than the height of the outlet 16.

The intermediate mouth 15, by virtue of its (convergent) configuration and its arrangement (between the sensor 10 and the mouth 6, so that the paper path between the sensitivity zone of the sensor 10 and the outlet 5 is not rectilinear), may represent an obstacle to the passage of an object introduced from outside through the outlet mouth 6, for preventing the external object from getting to shade the optical sensor 10.

The protecting means may comprise a movable wall 18 between a closure position, where the wall 18 closes the intermediate outlet 16 for preventing the introduction of objects from outside through the intermediate mouth 15, and an opening position, in which the intermediate outlet 16 is open to allow the passage of paper 4 towards the outlet 5. The wall 18 may be, as in this example, hinged about a pin 19. The wall 18 is structured and arranged so as to be opened by the thrust of the paper 4 advancing towards the outlet 5. The wall 18 is normally in the closure position due to the action of its own weight. In the closure position, the wall 18 interacts in contact with the intermediate mouth 15. The opening rotation of the wall 18 is free, whereby the thrust of the paper 4 may open the wall 18. The closing rotation of the wall 18 is limited by the abutment against the intermediate mouth 15.

The intermediate mouth 15, the outlet mouth 6 and the wall 18 may extend, in a direction transversal to the paper advancing direction F along the path, by a width not less than the width of the paper 4.

The sensor 10 may be located in a zone with a reduced width, e.g., at the center of the path of the paper 4.

Figure 6:
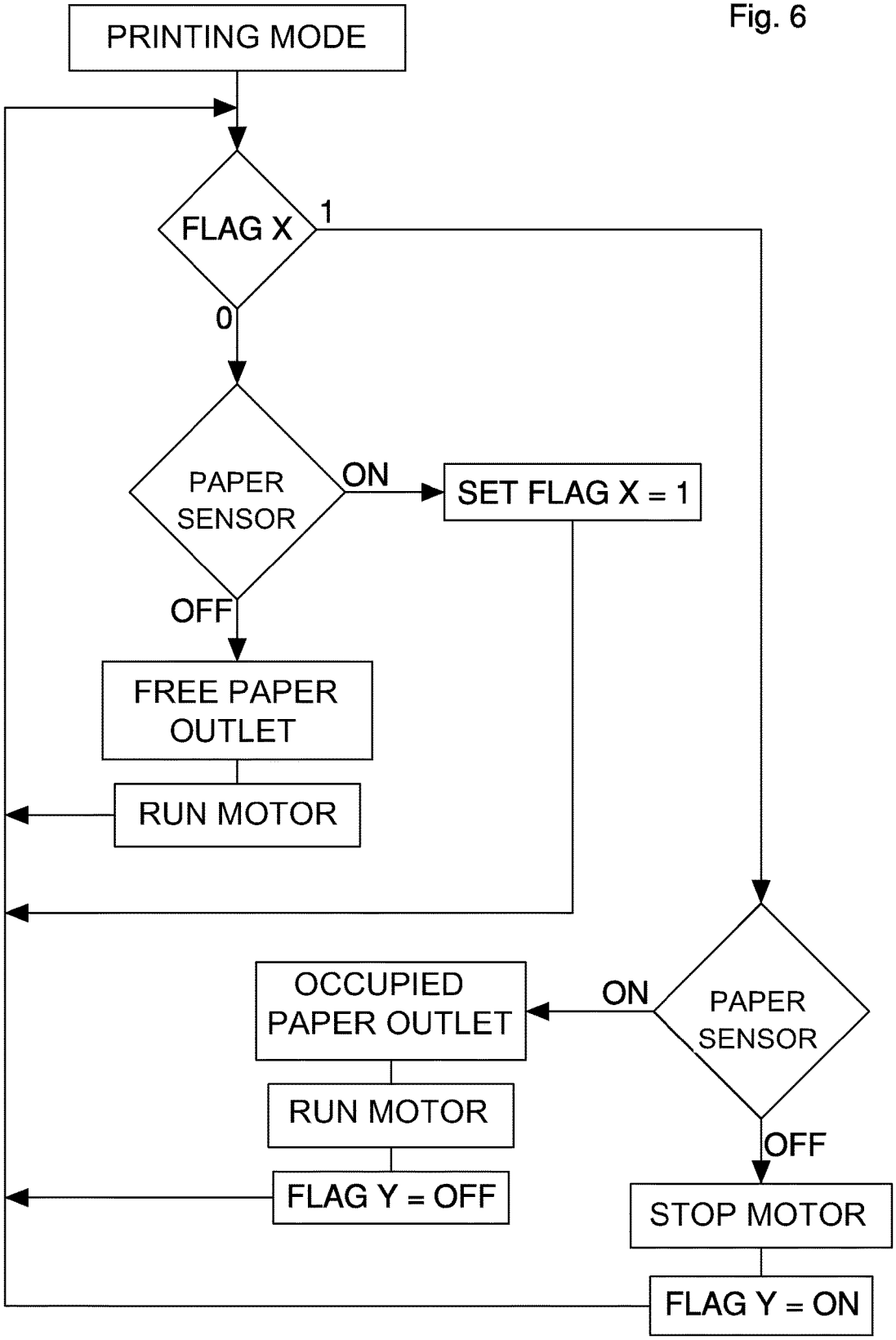
FIG. 6 is a diagram of the control procedure performed by the printing device of FIG. 1 during the print of a document.

The diagram of FIG. 6 shows the procedure carried out by the control means when the control means receives (e.g., by a user interface connected or belonging to the printing device) the input of running the print of a document (ticket, sales receipt, receipt, label or the like).

With FLAG X a status flag has been indicated, which may take, e.g., the values 0 and 1. In the resting period between a print and the other, after cutting a printed document and before beginning to print a new document (FIG. 3), the control means are programmed to set FLAG X=0.

As stated, the enabling to a new print only occurs when the paper presence sensor 10 is in the OFF configuration (free outlet 5).

When the control means receives the input of running a new print, the procedure of FIG. 6 (PRINTING MODE) begins. Since the paper presence sensor 10 is in the OFF configuration, it is possible to provide the enabling to the start of the print. Following the flow diagram, since FLAG X=0 and the paper sensor is OFF (free paper outlet), then the motor is started, which advances the paper (the motor of the roll 8) and the printing head 7 begins to print the document.

When the paper arrives (for the first time from the beginning of the print of the document) to the sensor 10 (FIG. 4), the sensor 10 passes to the ON configuration, whereby (see diagram of FIG. 6) the status flag is set to the value FLAG X=1.

From this moment on, if the paper sensor 10 remains in the ON configuration (occupied paper outlet), then the print proceeds regularly until the end of the same print, no obstructions to the advancing of paper being detected (a jamming flag may be set to the value FLAG Y=OFF), since there is no rise of the paper 4. On the contrary, if the paper sensor 10 passes to the OFF configuration before the end of the print, the print is then interrupted (at least temporarily), the absence of paper having been detected, due to a rise thereof caused by an obstruction to the advancing of paper (the jamming flag may be set to the value FLAG Y=ON). In fact, an obstruction to the normal advancing of the paper (e.g., an occlusion 14 at the outlet 5) causes the rise 13 of the paper at the sensor 10, which thereby no longer detects the presence of paper. If the occlusion 14 (e.g., a finger of the user) is removed, then the program instructions immediately restart the print, by exploiting the elasticity of the paper, which returns to be stretched in the lowered position next to the sensor 10 (return of the sensor to the ON configuration). Thus, the print may end without the formation of any jamming and without the need for carrying out any manual intervention (e.g., disentangling a paper entanglement).

When the print of the document has ended, the device ceases the above-described mode (PRINT MODE), automatically actuates a cutting mode, where the cutting means 11 is actuated for separating the printed document (ticket, receipt, etc.) which may be withdrawn by the user.

At the end of the print (and/or of the cutting) the status flag is automatically brought back to the value FLAG X=0, ready for the next print, which will begin only if the printed document will be withdrawn, i.e., if the paper presence sensor 10 returns to the OFF configuration (situation of non-occupied outlet 5). The print of a new document can begin only if FLAG X=0 and FLAG Y=OFF.

The printing device 1 is controlled so as to start the print of a document only if the sensor 10 does not detect the presence of non-raised paper (situation of non-occupied outlet 5, as in FIG. 3), to continue a started print until the sensor detects the presence of non-raised paper for the first time (initial printing step, as in FIG. 4), to continue the print (after the above-mentioned first detection) if the sensor 10 detects the presence of non-raised paper (printing step subsequent the initial step), to interrupt the print if the sensor no longer detects the presence of non-raised paper (situation of occlusion, as in FIG. 5), and to resume, after an interruption, the print of the same document if the sensor returns to detect the presence of non-raised paper (removal of the occlusion).

The invention claimed is:

1. A printing device comprising:

a path for supplying a paper towards an outlet of a printed document;

a print head for printing on the paper that advances along said path;

an alteration in said path for promoting a rise of the paper if the normal advancing of the paper is obstructed;

a sensor arranged along said path for detecting non-raised paper on said path;

a controller for interrupting said print head if said sensor no longer detects paper along said path.

2. The printing device according to claim 1, wherein said controller is programmable.

3. The printing device according to claim 2, comprising program instructions implementable on said controller for running the steps of:

starting the print of a document only if said sensor does not detect paper along said path;

continuing the print if said sensor detects non-raised paper along said path; and interrupting the print if said sensor no longer detects paper.

4. The printing device according to claim 3, comprising program instructions implementable on said controller for resuming the print of the same document if said sensor detects paper along said path after the print has been interrupted.

5. The printing device according to claim 2, comprising program instructions implementable on said controller for:

after the print of a document, operating a cutter for separating the printed document from the rest of the paper;

allowing the print of a new document after the cut only if said sensor does not detect paper along the path such that the printed document has passed to an outlet.

6. The printing device according to claim 1, wherein said controller is arranged for allowing the print of a new document only if said sensor does not detect paper along the path.

7. The printing device according to claim 1, comprising a cutter arranged in said path upstream of said sensor for separating the printed document from the rest of the paper, said controller arranged for operating said cutter at the end of the print of a document and for allowing the print of a new document only after cutting the printed document and only if said sensor does not detect paper along said path.

8. The printing device according to claim 1, wherein said sensor comprises an optical sensor having a focus along said paper path to detect non-raised paper.

9. The printing device according to claim 1, comprising a protector arranged between said sensor and a paper outlet for guarding the sensor against the introduction of objects from through said outlet.

10. The printing device according to claim 1, wherein said printing head comprises a paper advancing roll frontally coupled to said printing head, and wherein said altered paper path comprises a rise of said supplying path.

11. A method for controlling a printing device comprising the steps of:

starting the print of a document only if a paper sensor does not detect the presence of paper;

continuing the print of the document until said sensor detects the presence of paper;

after said detection, continuing the print of the document if said sensor detects the presence of paper and interrupting the print if said sensor no longer detects the presence of paper;

after an interruption, resuming the print of the same document if said sensor returns to detect the presence of paper.

* * * * *